United States Patent [19]

Jensen

[11] Patent Number: 4,545,541

[45] Date of Patent: Oct. 8, 1985

[54] MULTIPLE ROLL ROLLER MILL

[75] Inventor: Louis Jensen, London, Canada

[73] Assignee: Farmatic Inc., Ontario, Canada

[21] Appl. No.: 508,030

[22] Filed: Jun. 27, 1983

[30] Foreign Application Priority Data

Apr. 26, 1983 [CA] Canada ..... 426693

[51] Int. Cl.[4] ..... B02C 4/08; B02C 4/32

[52] U.S. Cl. ..... 241/145; 241/228; 241/230

[58] Field of Search ..... 241/143, 144, 145, 227–234

[56] References Cited

U.S. PATENT DOCUMENTS

| | | | |
|---|---|---|---|
| 260,784 | 7/1882 | Pye | 241/144 |
| 830,075 | 9/1906 | Joel | 241/144 |
| 2,144,841 | 1/1939 | Glaser . | |
| 2,182,131 | 12/1939 | Maede . | |
| 3,199,798 | 8/1965 | Turner . | |
| 3,208,677 | 9/1965 | Hesse . | |
| 3,346,199 | 10/1967 | Strite . | |

*Primary Examiner*—Howard N. Goldberg
*Assistant Examiner*—Timothy V. Eley
*Attorney, Agent, or Firm*—Pollock, Vande Sande & Priddy

[57] ABSTRACT

A multiple-roll roller mill, useful in particular for livestock feed processing, is disclosed. The mill includes a main roller and at least two secondary rollers, each secondary roller opposing a different axial portion of the main roller circumference and thereby defining axially separate mill sections. Each secondary roller is independently adjustable towards and away from the main roller. A chain and sprocket arrangement gangs the adjustment means for opposite ends of each secondary roller to ensure that the rollers remain parallel when adjusted. Pressure springs urge the secondary rollers toward their adjusted positions, but allow movement away from the main roller when the spring pressure is overcome. A chain drive is employed which includes moveable idler sprockets arranged so as to maintain relatively constant chain tension when the roller positions are adjusted.

13 Claims, 5 Drawing Figures

MULTIPLE ROLL ROLLER MILL

FIELD OF INVENTION

This invention relates generally to roller mills, particularly to roller mills used in livestock feed processing, and more particularly to livestock feed roller mills which permit simultaneous milling of different feed components.

BACKGROUND TO THE INVENTION

For efficient production of livestock feed, it is preferable to be able to supply different feed components in unprocessed form to hoppers of a mill, using metering means or premeasuring the quantities to effect the desired mixture, rather than having to mill the feed components separately and then have a separate mixing step.

Ordinarily, it is desirable that nothing be done to the grain in a mill beyond cracking it. In feeding cows, for example, it is undesirable to have the grain finely ground, as a coarse grain mix stimulates rumination or cud chewing and results in the desired high butterfat levels in the cows' milk.

Accordingly, there is a problem in producing a mill which will mill different feed components in optimum fashion. For example, it is frequently desirable to produce a mixture of corn and dry oats or barley. Not only does corn require a larger spacing between rollers than oats or barley, but furthermore the grooves in the rollers should preferably be wider and deeper than for oats or barley in order to achieve the perfect crack.

The main way of dealing with this problem in the past, apart from milling the different components at different times and mixing them subsequently, has been to provide completely separate mills fed by separate hoppers, with the output from the separate mills being mixed by funnelling them into a common output. These separate mills may have differently grooved rollers.

Another way developed to deal with the problem is that described in Canadian Pat. No. 1,075,658 (Keil). Keil describes a "split roll" roller mill, in which there are two identical opposing rollers, each roller having one section of one diameter and another section of a slightly smaller diameter, the smaller diameter section also having wider and deeper grooves for grinding. Thus two different roller grinding surfaces and spacings are provided for any given mill setting. Although certainly a useful improvement, Keil's mill obviously does not permit independent adjustment of the two different roller spacings.

SUMMARY OF THE INVENTION

It is an object of the present invention to provide an improved roller mill which overcomes some of these problems and which thereby facilitates simultaneous processing of different feed components.

In accordance with one aspect of the present invention there is provided a frame, a main roller rotatably carried by the frame, two secondary rollers rotatably carried by the frame, each secondary roller opposing a different axial portion of the circumference of the main roller, thereby defining axially separate mill sections, adjustment means for independently adjusting the position of each secondary roller towards and away from the main roller, and drive means connected for driving at least the main roller. Adjustment means, feed component supply means, and drive means are provided.

According to a further aspect of the invention, there may be provided adjustment means comprising adjusting screws for adjustment of of each bearing block position, and sprocket and chain means for ganging adjustment screws of the bearing block pairs to ensure parallel adjustment of the secondary rollers with respect to the main roller.

According to yet another feature of the invention, stop means may be provided on each adjusting screw for preventing axial movement of the adjusting screws towards the main roller when registered against the frame. Biasing means such as coil springs may be provided for resisting axial movement of the adjusting screws away from the main roller. Thus a potentially damaging force, sufficient to overcome the biasing means force, produces axial movement of the stop means away from the frame, thereby producing movement of the secondary roller away from the main roller, thereby preventing damage to the rollers. As a further feature, the biasing force may be made adjustable.

In yet another aspect of the invention, the drive means include sprockets on one end of the shafts of the main and secondary rollers, and one idler sprocket per secondary roller, with a chain training over all of the sprockets so as to drive the secondary rollers from rotation of the main roller. The idler sprockets are moveable and their movements are linked to movement of the secondary rollers in such a fashion that chain tension remains approximately constant.

BRIEF DESCRIPTION OF THE DRAWINGS

In order that the invention may be more clearly understood, there now follows a detailed description in which reference is made to the drawings in which.

DESCRIPTION OF THE PREFERRED EMBODIMENT

Figure 1:
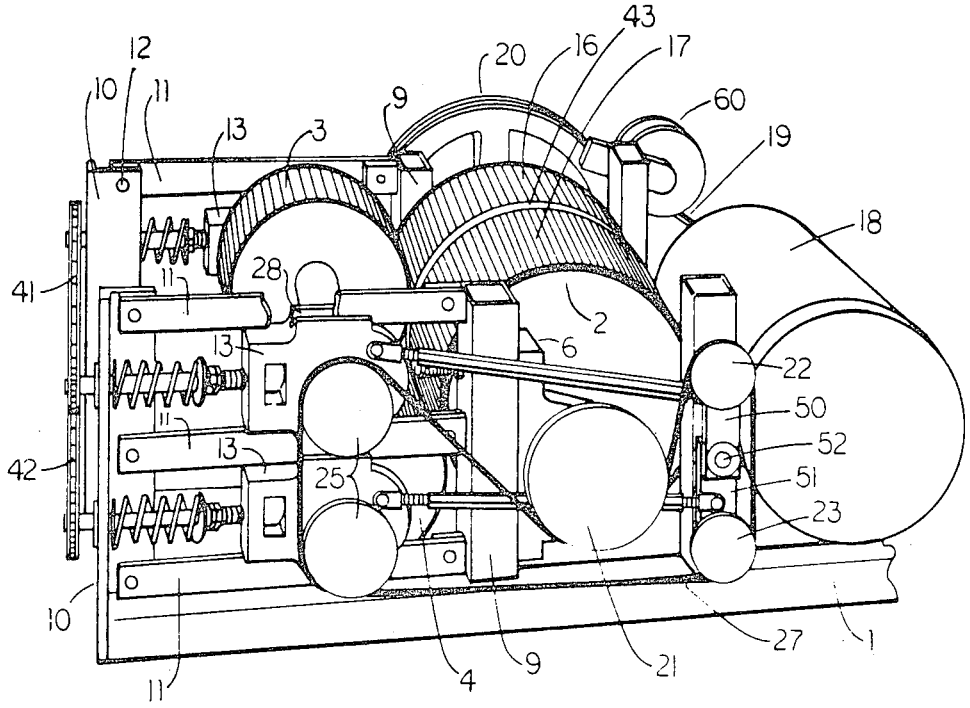
FIG. 1 is a perspective of the preferred embodiment, a three-roll roller mill.
Figure 2:
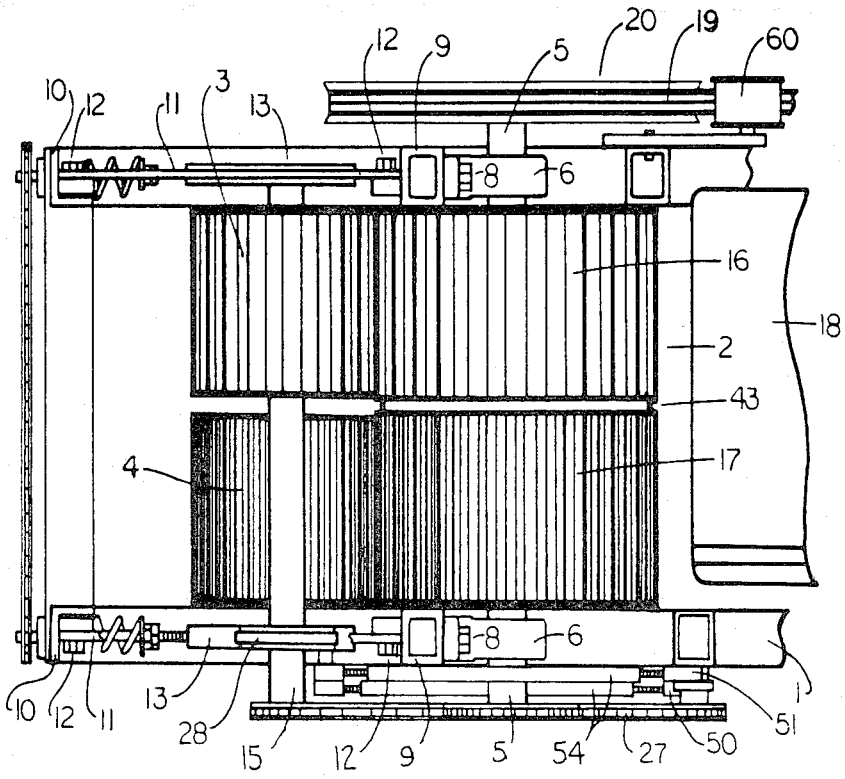
FIG. 2 is a plan view of the mill.
Figure 3:
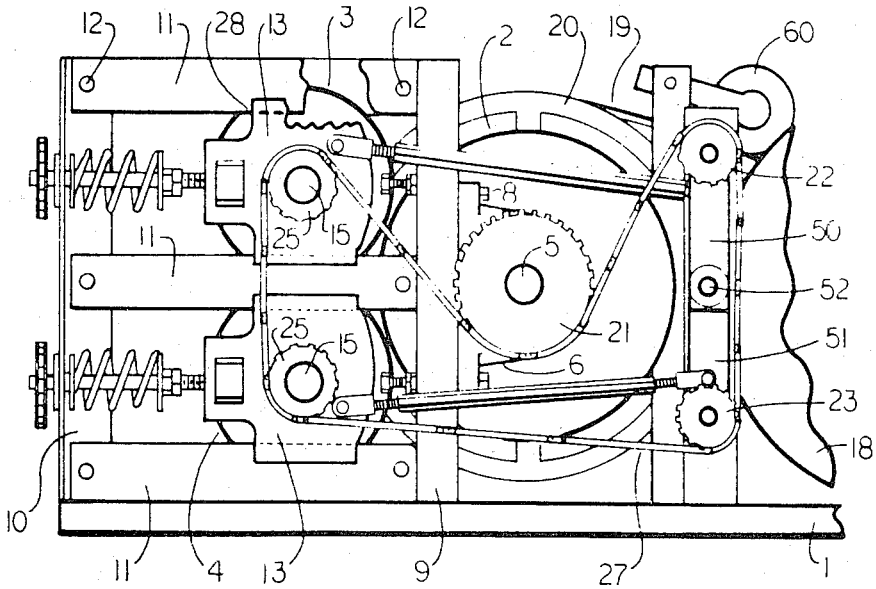
FIG. 3 is a side elevation of the mill.

Referring first to FIGS. 1, 2, and 3, there is illustrated a three-roll roller mill comprising a frame 1, and main roller 2, and upper and lower secondary rollers, 3 and 4 respectively. The main roller 2 is supported on a main roller shaft 5 which is carried transversely in the frame 1 by two bearing support yokes 6 containing main roller support bearings (not shown). The bearing support yokes 6 are securely mounted on the frame 1 by bolts 8.

The frame 1 has central upright members 9 and upright end members 10 which support carriage rails 11. The carriage rails 11 are connected at each end to the upright members 9 and 10 by bolts 12.

Mounted between the sets of carriage rails on either side of the frame are bearing blocks 13, each carrying a self-aligning secondary roller support bearing (not shown). The secondary roller support bearings on opposite sides of the frame support transversely between them the secondary roller shafts 15. The secondary roller shafts support the upper secondary roller 3 and the lower secondary roller 4 respectively. The bearing blocks 13 are slidable along the carriage rails 11, so that the secondary rollers 3 and 4 are moveable generally towards and away from the main roller 2.

The main roller 2 has separate sections 16 and 17, which oppose the secondary rollers 3 and 4 respectively. Separating sections 16 and 17 is an undercut groove 43. In the overall mill assembly, a vertical baffle (not illustrated) is secured above the rollers and extends down to and preferably into the groove, extending also at least partially between the secondary rollers, so that the two mill sections are kept substantially separate. Any suitable baffle arrangement may be employed, such as one similar to that shown in the above-mentioned Keil patent, and it is obvious how such a baffle could be constructed and arranged. Feed components are separately supplied to separate sides of the baffle using any suitable hopper arrangement, preferably incorporating metering means.

All of the rollers are grooved for milling of the feed components, and the grooves of the upper secondary roller 3 correspond with the grooves of the main roller section 16, while the grooves of the lower secondary roller 4 correspond with the grooves of the main roller section 17. Preferably the two mill sections have different roller groove widths and depths so that each section is better than the other for specific feed components.

A motor 18 mounted at the end of the frame drives the main roller 2 via a dual belt 19 and large dual sheave 20 attached to an extended portion of the main roller shaft 5. An adjustable belt tensioning roller 60 is also provided. On the other end of the main roller shaft 5 is a sprocket 21, which by virtue of idler sprockets 22 and 23, sprockets 25 mounted on the extended ends of the secondary roller shafts 15, and a chain 27 training over these sprockets, drives the secondary rollers 3 and 4. Naturally, the sprockets are selected in relation to the roller diameters such that the circumferential speeds of the secondary rollers are matched to the circumferential speeds of the main roller. The idler sprockets 22 and 23 are rotatably mounted on the ends of idler arms 50 and 51 respectively, the other ends of the idler arms being pivotally connected to the frame at a pivot pin 52. Adjustable tensioning rods 54 are attached between the bearing blocks 13 and the idler arms 50 and 51 as illustrated, the geometry of the arrangement being such that adjustment of a bearing block position produces movement of the corresponding idler sprocket such that chain tension remains relatively constant. The adjustability of the length of the tensioning rods 54 of course permits chain tension to be varied as desired.

Figure 4:
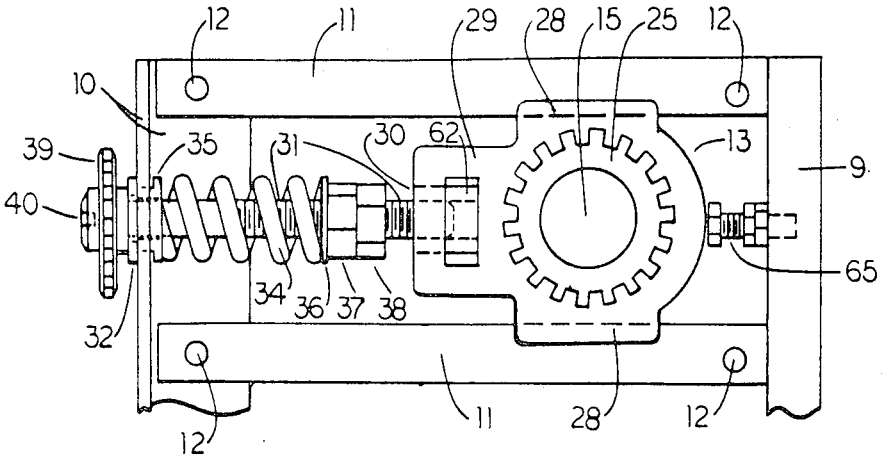
FIG. 4 is an elevation showing the adjusting screw, spring and bearing block arrangement in the mill.

Referring now to FIG. 4, the bearing blocks 13 and their means of adjustment will be described in more detail. As already mentioned, each bearing block 13 carries a self-adjusting secondary roller support bearing, which in turn carries rotatably a secondary roller shaft 15. The upper and lower surfaces of the bearing blocks have channels 28 in which the carriage rails 11 fit relatively securely so that the bearing blocks can slide back and forth on the carriage rails with a minimum of vibration or lateral play.

Each bearing block 13 has a neck portion 29 extending in the direction of the upright end members 10 of the frame 1. The neck portion has a threaded aperture 30 into which is threaded a sleeve 62. The sleeve has internal threads which receive the correspondingly threaded end of an adjusting screw 31. The adjusting screw 31 extends to and passes through the upright end member 10, and is provided with a stop washer 32 which when registered against the upright end member 10 prevents movement of the adjusting screw 31 towards the main roller 2. Around the adjusting screw 31 is a pressure spring 34 in the form of a coil spring, compressed between a bushing 35 and a washer 36. The bushing has a neck portion which bears against the stop washer 32, and the length of the neck portion is slightly greater than the thickness of the upright end member 10. Thus the upright end member 10 is not sandwiched tightly between the stop washer 32 and the shoulder portion of the bushing, but rather there is a slight gap to facilitate rotation of the adjusting screw 31. The washer 36 is secured against axial movement towards the bearing block 13 by nuts 37 and 38 threaded onto the adjusting screw. As can be clearly seen from FIG. 4, the tension of the pressure spring 34 can be readily varied by adjusting the position of the washer 36 using the nuts 37 and 38. It can also be seen from FIG. 4 that under normal conditions, the pressure spring 34 will urge the stop washer 32 against the bushing 35. However, if a sufficiently strong force is transmitted through a secondary roller to the bearing block 13, then the force of the spring is overcome and the stop washer 32 moves out of registration with the bushing 35. That is, the whole adjusting screw, bearing block, and secondary roller assembly moves in response to this relatively large force, so as to prevent damage to the rollers. In ordinary operation, the shoulder portion of the bushing 35 registers against the upright end member 10, with the result that there is a slight gap (approximately 1/32 of an inch or 1 mm.) between the upright end member 10 and the stop washer 32. In the drawings, an exaggerated gap is shown between the bushing shoulder and the end member, where it is normally when the rollers are being adjusted. There is thus a built-in-play of about 1 mm., although that play is not in evidence during normal operation.

Adjustment of the bearing block positions and, hence of the spacing between the secondary rollers and the main rollers, is effected by rotating the adjusting screws 31, since such rotation results in the bearing blocks being threaded further onto or off the adjusting screws.

Adjustable stops 65 are provided to prevent adjusting the secondary rollers into contact with the main roller, or to less than any selected minimum clearance.

Figure 5:
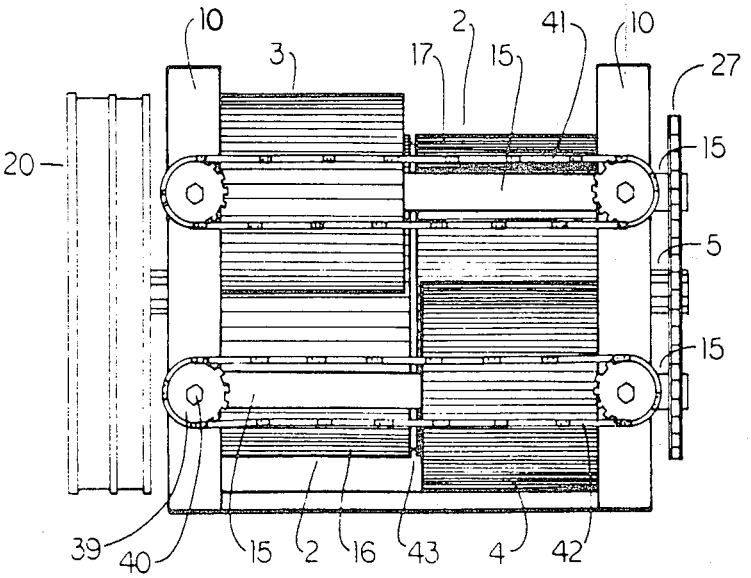
FIG. 5 is an end elevation of the mill.

As can be seen clearly from FIG. 5, each adjusting screw has a sprocket 39 on its end, outside the upright end members 10 of the frame. Each sprocket has a key hole 40 for accommodating an Allen wrench to facilitate rotating the adjusting screws. The sprockets on the ends of corresponding pairs of adjusting screws are ganged together by means of chains 41 and 42, so that adjustment of one bearing block position by means of rotating its adjusting screw produces equal movement of the corresponding bearing block by virtue of the ganged rotation of its adjusting screw. Thus, the secondary rollers remain parallel to the main roller at all times.

Naturally, the direction of rotation of the rollers is such that the feed components are processed from top to bottom. It will be noted that the arrangement of the chain 27 with respect to the sprockets 21, 22, 23 and two sprockets 25 is such that the secondary rollers rotate opposite the direction of rotation of the main roller.

It will be appreciated that the above description is of the preferred embodiment only, and that many other arrangements are within the scope of the invention. As just one example, it is conceivable that the mill of the present invention could have more than two secondary rollers provided that appropriate and obvious modifications were made. This description of the invention should not be interpreted as to unduly restrict the broad scope of the invention.

What is claimed as the invention is:

1. A roller mill comprising:

a frame having opposing sidewalls;

a main roller rotatably carried by said frame;

two secondary roller means each having a secondary roller and a shaft mounted for rotation between said opposing sidewalls in a pair of bearing means carried by said frame, each secondary roller opposing in spaced relation to a different axial portion of the circumference of said main roller so as to define axially separate mill sections for independently milling materials supplied separately to each of said axially separate mill sections;

adjustment means for independently adjusting the position of each secondary roller towards and away from the main roller; and, drive means connected for driving at least said main roller; the rotational axes of said secondary rollers being spaced vertically relative to each other and the shaft of at least one of said secondary roller means having a portion extending axially past the secondary roller of the other secondary roller means such that one bearing means for said at least one secondary roller means is carried by one of said frame sidewalls and the other bearing means for said at least one secondary roller means is carried by the other of said frame sidewalls.

2. A roller mill as recited in claim 1, in which one mill section has a roller groove configuration different from a roller groove configuration of the other mill section.

3. A roller mill according to claim 1 in which each of said secondary roller shafts has a portion extending axially past the other secondary roller such that one bearing means of each of said secondary rollers is carried by one of said frame sidewalls and the other bearing means of each of said secondary rollers is carried by the other of said frame sidewalls.

4. A roller mill according to claim 1 in which the rotational axes of said secondary rollers are spaced vertically one above the other; and in which the rotational axis of one of said secondary rollers is above the rotational axis of said main roller, and the rotational axis of the other secondary roller is below the rotational axis of said main roller.

5. A roller mill comprising:

a frame having opposing sidewalls;

a main roller rotatably carried transversely in said frame;

two pairs of bearing blocks mounted in said frame for sliding movement generally towards and away from one side of said main roller, each pair of bearing blocks rotatably carrying between them a secondary roller shaft having an axis parallel to the main roller axis, each such shaft having a radially extending portion defining a secondary roller, each secondary roller opposing in spaced relation a different axial portion of the circumference of said main roller so as to define axially separate mill sections for independently milling materials supplied separately to each of said axially separate mill sections;

adjustment means for independently adjusting the position of each of said bearing blocks within the frame so as to provide independent adjustment of the spacing between the main roller and each secondary roller; and, drive means connected for driving at least said main roller, the rotational axes of said secondary rollers being spaced vertically relative to each other and each secondary roller shaft having a bearing portion extending axially past the secondary roller portion of the other secondary roller such that one bearing block of each of said pairs is carried by one of said frame sidewalls and the other bearing block of each of said pairs is carried by the other of said frame sidewalls.

6. A roller mill as recited in claim 5, further comprising biasing means associated with said adjustment means for providing a biasing force urging said bearing blocks towards their adjusted positions and generally towards the main roller, said biasing means permitting independent movement of the bearing blocks and hence of each secondary roller away from said main roller when a force greater than said biasing force is applied respectively against each secondary roller.

7. A roller mill as recited in claim 5, in which said adjustment means comprises:

an adjusting screw for each bearing block, oriented at 90° to the main roller axis, means for rotatably connecting each adjusting screw at one end to the frame and for normally preventing axial movement, each adjusting screw being threaded at the other end into its respective bearing blocks, each bearing block being provided with an internally threaded aperture for receiving said threaded adjusting screw end, rotation of the adjusting screw thereby adjusting the position of the bearing block along the adjusting screw;

a sprocket attached to each adjusting screw; and for each pair of adjusting screws, corresponding to a pair of bearing blocks and a secondary roller, a chain training around said sprockets of said pair of adjusting screws, whereby rotation of one adjusting screws produces identical rotation of the paired adjusting screw, thereby ensuring that the corresponding secondary roller remains parallel to the main roller.

8. A roller mill as recited in claim 7, in which said adjusting screw to frame connecting means comprises:

stop means on each adjusting screw, for limiting axial movement of each adjusting screw towards the main roller;

frame end walls, said end walls having holes for accommodating the adjusting screws;

a bushing in each hole and around said adjusting screw, said bushing having a neck portion and a flange portion; and biasing means providing a biasing force urging together said flange portion and said stop means;

whereby a force, sufficient to overcome the biasing force, produces axial movement of said stop means away from the flange portion so as to produce movement of the secondary roller away from the main roller, thereby preventing damage to the rollers.

9. A roller mill as recited in claim 8, in which said biasing means comprises, for each adjusting screw, a coil spring around the adjusting screw compressed between the corresponding end wall and spring retention means on the adjusting screw.

10. A roller mill as recited in claim 9, in which said spring retention means are adjustable with respect to the adjusting screws so that compression of the coil spring may be adjusted.

11. A roller mill as recited in any one of claims 5 to 10, in which one mill section has a roller groove configuration different from a roller groove configuration of the other mill section.

12. A roller mill as recited in any one of claims 5 to 10 in which said drive means include sprocket and chain means for driving the secondary rollers from rotation of the main roller, said sprocket and chain means comprising sprockets on one end of the shafts of the main and secondary rollers, idler sprockets rotatably and moveably supported from the frame, there being one idler sprocket corresponding to each secondary roller, a chain training over all of said sprockets, and a tensioning rod between each bearing block and support means for its corresponding idler sprocket, whereby adjustment of a bearing block moves the corresponding idler sprocket, said movement being such that the chain path length around the sprockets, and hence the chain tension, remains approximately constant.

13. A roller mill as recited in any of claims 5 to 10 in which said drive means includes a sprocket and chain means for driving the secondary rollers from rotation of the main roller, said sprocket and chain means comprising sprockets on one end of the shafts of the main and secondary rollers, idler sprockets rotatably and moveably supported from the frame, there being one idler sprocket corresponding to each secondary roller, a chain training over all of said sprockets, and a tensioning rod between each bearing block and support means for its corresponding idler sprocket, whereby adjustment of a bearing block moves the corresponding idler sprocket, said movement being such that the chain path length around the sprockets, and hence the chain tension, remains approximately constant; and in which one mill section has a roller groove configuration different from a roller groove configuration of the other mill section.

* * * * *